US009110487B2

(12) United States Patent
Sakaguchi et al.

(10) Patent No.: US 9,110,487 B2
(45) Date of Patent: Aug. 18, 2015

(54) VOLTAGE REGULATOR

(75) Inventors: Kaoru Sakaguchi, Chiba (JP); Takashi Imura, Chiba (JP)

(73) Assignee: Seiko Instruments Inc. (JP)

( * ) Notice: Subject to any disclaimer, the term of this patent is extended or adjusted under 35 U.S.C. 154(b) by 32 days.

(21) Appl. No.: 13/462,440

(22) Filed: May 2, 2012

(65) Prior Publication Data

US 2012/0286751 A1 Nov. 15, 2012

(30) Foreign Application Priority Data

May 12, 2011 (JP) ..... 2011-107610

(51) Int. Cl.
*G05F 3/16* (2006.01)
*G05F 1/573* (2006.01)

(52) U.S. Cl.
CPC ..... *G05F 1/573* (2013.01)

(58) Field of Classification Search
CPC ..... G05F 1/573; G05F 1/5735; G05F 1/569; G05F 3/262
USPC ..... 323/311–317
See application file for complete search history.

(56) References Cited

U.S. PATENT DOCUMENTS 5,191,278 A * 3/1993 Carpenter ..... 323/275
6,452,766 B1 * 9/2002 Carper ..... 361/18
7,215,103 B1 * 5/2007 Wong et al. ..... 323/277
2004/0004466 A1 * 1/2004 Miyanaga et al. ..... 323/277
2004/0004467 A1 * 1/2004 Miyanaga et al. ..... 323/277
2004/0104711 A1 * 6/2004 Scoones et al. ..... 323/280
2005/0029999 A1 * 2/2005 Fukui ..... 323/285
2007/0194768 A1 * 8/2007 Bansal et al. ..... 323/277
2008/0174289 A1 * 7/2008 Gurcan et al. ..... 323/280
2009/0180231 A1 * 7/2009 Tanaka ..... 361/93.9
2009/0273323 A1 * 11/2009 Kimura ..... 323/265
2010/0207591 A1 * 8/2010 Imura ..... 323/265
2011/0074370 A1 * 3/2011 Imura et al. ..... 323/277

FOREIGN PATENT DOCUMENTS

JP 2005-293067 A 10/2005
JP 2008-140113 A 6/2008

* cited by examiner

*Primary Examiner* — Adolf Berhane
*Assistant Examiner* — Henry Lee, III
(74) *Attorney, Agent, or Firm* — Brinks Gilson & Lione

(57) ABSTRACT

Provided is a voltage regulator including an overcurrent protection circuit, which does not need a test circuit. The voltage regulator has a configuration in which a reference voltage circuit includes an element that determines a reference voltage and an overcurrent protection circuit includes an element that determines a maximum output current, the element of the reference voltage circuit and the element of the overcurrent protection circuit having the same characteristics. Accordingly, there is a correlation between an output voltage before trimming and the maximum output current for overcurrent protection. Thus, a maximum output current before trimming can be estimated without performing evaluation by a test circuit.

2 Claims, 10 Drawing Sheets

VOLTAGE REGULATOR

RELATED APPLICATIONS

This application claims priority under 35 U.S.C. §119 to Japanese Patent Application No. 2011-107610 filed on May 12, 2011, the entire content of which is hereby incorporated by reference.

BACKGROUND OF THE INVENTION

1. Field of the Invention

The present invention relates to a voltage regulator including an overcurrent protection circuit.

2. Description of the Related Art

Description is made of a conventional voltage regulator. FIG. 9 is a diagram illustrating the conventional voltage regulator.

The conventional voltage regulator includes a ground terminal 100, a power supply terminal 101, an output terminal 102, a reference voltage circuit 103, a differential amplifier circuit 104, an output transistor 105, a voltage dividing circuit 106, and an overcurrent protection circuit 107.

Description is made of an operation of the conventional voltage regulator.

When an output voltage Vout of the output terminal 102 is higher than a predetermined voltage, that is, when a divided voltage Vfb of the voltage dividing circuit 106 is higher than a reference voltage Vref, an output signal of the differential amplifier circuit 104 becomes higher. A gate voltage of the output transistor 105 increases, and hence the output transistor 105 is gradually turned OFF and the output voltage Vout decreases. On the other hand, when the output voltage Vout is lower than the predetermined voltage, the output voltage Vout increases in the same manner as described above. In other words, the output voltage Vout of the voltage regulator is maintained to a constant predetermined voltage.

When the output voltage Vout of the voltage regulator decreases due to an increase in load, an output current Iout increases to be a maximum output current Im. Then, in accordance with the maximum output current Im, a larger current flows through a sense transistor 121 which is current-mirror-connected to the output transistor 105. At this time, a voltage generated across a resistor 154 increases to gradually turn ON an NMOS transistor 123, and a voltage generated across a resistor 153 increases. Then, a PMOS transistor 124 is gradually turned ON, and a gate-source voltage of the output transistor 105 decreases to gradually turn OFF the output transistor 105. Accordingly, the output current Iout does not exceed the maximum output current Im but is fixed to the maximum output current Im, and hence the output voltage Vout decreases. In this case, due to the voltage generated across the resistor 154, the gate-source voltage of the output transistor 105 decreases to gradually turn OFF the output transistor 105, and the output current Iout is fixed to the maximum output current Im. Therefore, the maximum output current Im is determined by a resistance of the resistor 154 and a threshold of the transistor 123 (see Japanese Patent Application Laid-open No. 2005-293067).

In order to set an accurate maximum output current Im, it is necessary to adjust the resistance of the resistor 154 and the threshold of the transistor 123 accurately. For the adjustment, trimming is performed after evaluation of characteristics of the resistor 154 and the transistor 123. The evaluation is performed on alternative elements having the same characteristics as those of the resistor 154 and the transistor 123.

FIG. 10 is a diagram illustrating a conventional voltage regulator including a test circuit. The conventional voltage regulator including the test circuit further includes a voltage detector 111, a first switch 191, a second switch 192, and an alternative element 112 under evaluation.

When an output of the voltage dividing circuit 106 is input to the voltage detector 111, the first switch 191 is controlled by an output of the voltage detector 111. When the first switch 191 is short-circuited, a current flows through the alternative element 112 under evaluation from the output terminal 102. When the second switch 192, which is controlled by the output of the voltage detector 111, is short-circuited, a PMOS transistor 129 is gradually turned OFF, and no current flows through an internal circuit element 113 from the output terminal 102. Accordingly, with the use of the configuration of FIG. 10, the electrical characteristics of the alternative element 112 under evaluation can be evaluated accurately (see Japanese Patent Application Laid-open No. 2008-140113).

In the conventional technology, however, in order to perform overcurrent protection trimming to set the maximum output current Im of the voltage regulator accurately, it is necessary to prepare a special test circuit for evaluating the element that determines the maximum output current Im. The test circuit becomes unnecessary when the voltage regulator functions as a product. Accordingly, the presence of the test circuit leads to a larger chip area of a voltage regulator IC. As the chip area increases, the number of chips per wafer is reduced, which is disadvantageous in terms of cost. In addition, the presence of a test step of evaluating the electrical characteristics of the alternative element under evaluation leads to a higher manufacturing cost of the IC, which is disadvantageous in terms of cost.

SUMMARY OF THE INVENTION

In view of the above-mentioned problems, the present invention provides a voltage regulator which does not need a test circuit and a test step for determining a maximum output current accurately.

In order to solve the conventional problems, a voltage regulator of the present invention has a configuration in which a reference voltage circuit includes an element that determines a reference voltage Vref and an overcurrent protection circuit includes an element that determines a maximum output current Im, the element of the reference voltage circuit and the element of the overcurrent protection circuit having the same characteristics.

According to the voltage regulator of the present invention, the maximum output current Im can be estimated without evaluating an alternative element under evaluation of the overcurrent protection circuit by a test circuit. An output voltage Vout before trimming is determined based on a characteristic value of the element that determines the reference voltage Vref included in the reference voltage circuit. On the other hand, the element that is included in the overcurrent protection circuit and determines the maximum output current Im has the same characteristics as those of the element that determines the reference voltage Vref. Therefore, there is a correlation in manufacturing fluctuations between the output voltage Vout and the maximum output current Im, and hence the maximum output current Im can be grasped without any test circuit and any test step for the element that determines the maximum output current Im. Thus, according to the voltage regulator of the present invention, the chip area can be reduced because the test circuit is not used, and the test step can be eliminated, and hence there is an effect that manufacturing cost can be reduced.

DETAILED DESCRIPTION OF THE PREFERRED EMBODIMENT

Figure 1:
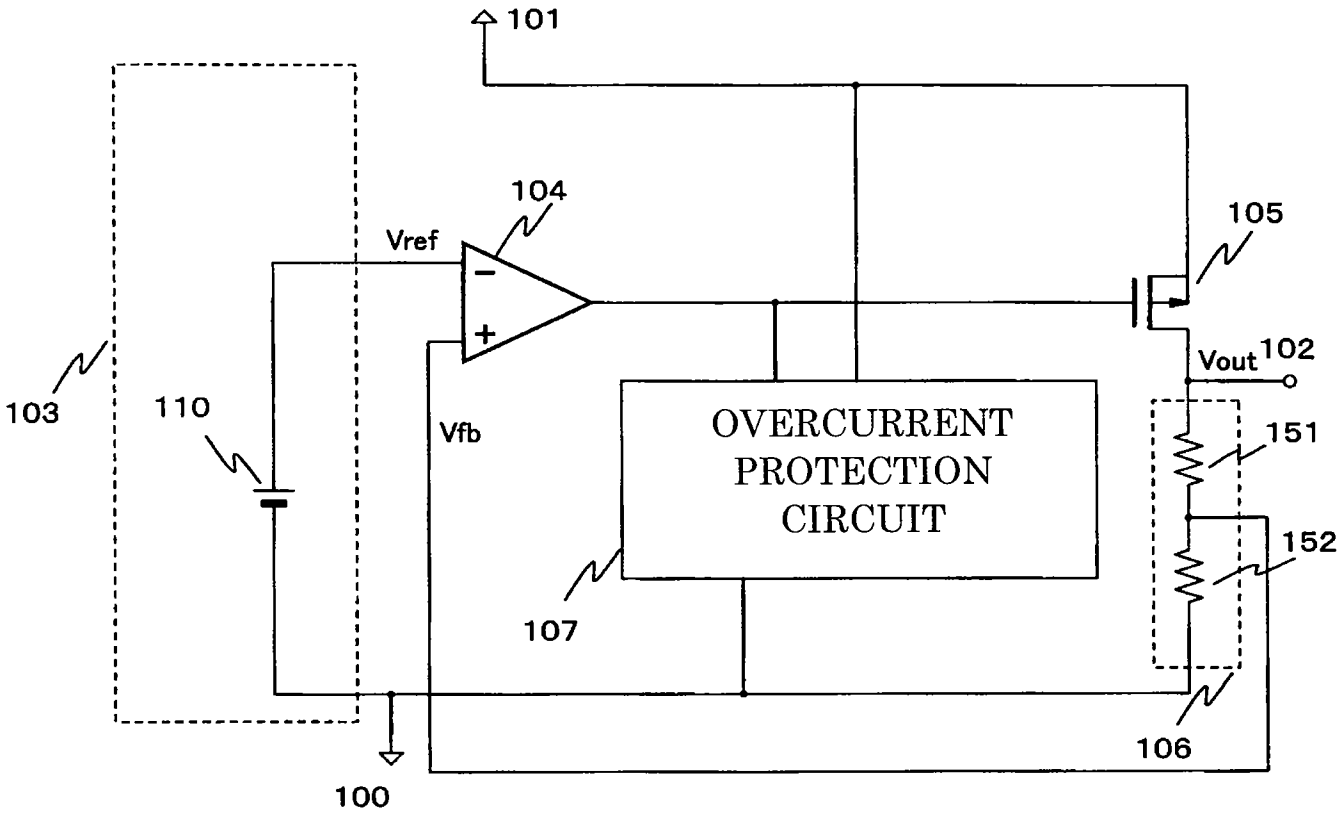
FIG. 1 is a circuit diagram illustrating a voltage regulator of an embodiment of the present invention.

FIG. 1 is a circuit diagram illustrating a voltage regulator according to an embodiment of the present invention.

The voltage regulator of this embodiment includes a reference voltage circuit 103, a differential amplifier circuit 104, an output transistor 105, a voltage dividing circuit 106 including a resistor 151 and a resistor 152, and an overcurrent protection circuit 107.

The differential amplifier circuit 104 has an inverting input terminal connected to an output terminal of the reference voltage circuit 103, a non-inverting input terminal connected to an output terminal of the voltage dividing circuit 106, and an output terminal connected to the overcurrent protection circuit 107 and a gate of the output transistor 105. The output transistor 105 has a source connected to a power supply terminal 101 and a drain connected to an output terminal 102. The voltage dividing circuit 106 is connected between the output terminal 102 and a ground terminal 100. A connection point between the resistor 151 and the resistor 152 is connected to the non-inverting input terminal of the differential amplifier circuit 104.

In the voltage regulator of this embodiment, an element that determines a reference voltage Vref included in the reference voltage circuit 103 and an element that determines a maximum output current Im included in the overcurrent protection circuit 107 have the same characteristics. With this, there is a positive correlation between the reference voltage Vref and the maximum output current Im. Alternatively, the element that determines the reference voltage Vref included in the reference voltage circuit 103 and an element included in the overcurrent protection circuit 107 that determines an output current exhibited when an output voltage Vout is 0 V, that is, a short-circuit current Is, have the same characteristics. With this, there is a positive correlation between the reference voltage Vref and the short-circuit current Is. In particular in a semiconductor integrated circuit, elements having the same characteristics have high relative accuracy and hence have a relatively high correlation.

The output voltage Vout is determined by the reference voltage Vref and a voltage division ratio of the resistor 151 and the resistor 152 of the voltage dividing circuit 106. That is, if the voltage division ratio of the resistors 151 and 152 is known, the reference voltage Vref can be estimated from the output voltage Vout. In a semiconductor integrated circuit, the accuracy of a resistor ratio is high, and hence it is considered that an actual voltage division ratio of the resistors has a value almost as designed. Therefore, the reference voltage Vref can be estimated from the output voltage Vout. In other words, the maximum output current Im can also be estimated from the output voltage Vout.

In the conventional configuration, in order to determine the maximum output current Im or the short-circuit current Is accurately, a test circuit for evaluating the maximum output current Im or the short-circuit current Is is necessary. However, with the use of the configuration of this embodiment, the test circuit becomes unnecessary, and hence the chip area can be reduced. In addition, with the use of the configuration of this embodiment, a measurement step by the test circuit can be eliminated.

As described above, according to the voltage regulator of this embodiment, the chip area can be reduced and the test step can be shortened, and hence an effect of reducing manufacturing cost can be obtained.

Figure 2:
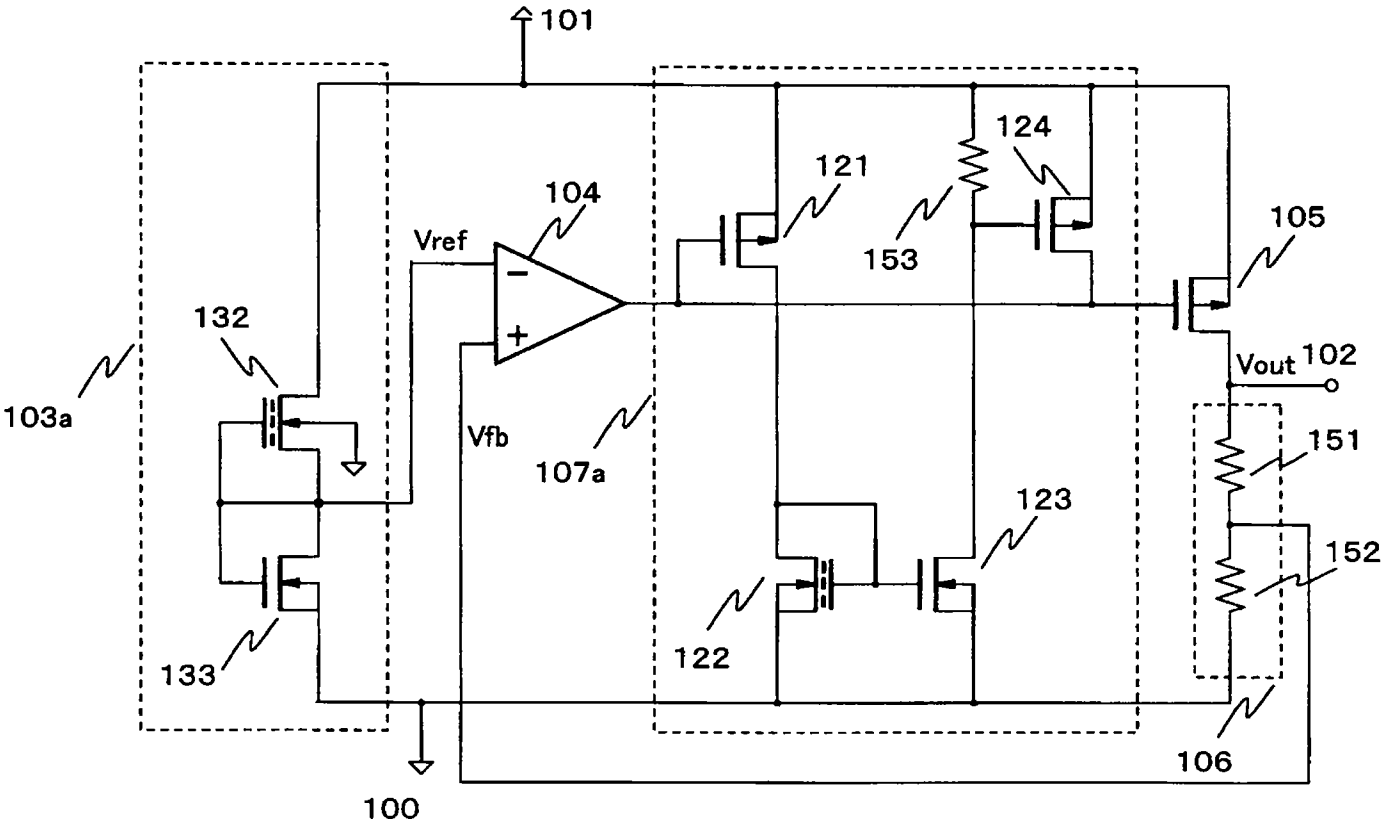
FIG. 2 is a circuit diagram illustrating an example of the voltage regulator of the embodiment of the present invention.

FIG. 2 is a circuit diagram illustrating an example of the voltage regulator of this embodiment. FIG. 2 illustrates specific examples of the overcurrent protection circuit 107 and the reference voltage circuit 103.

A reference voltage circuit 103*a* of FIG. 2 includes an NMOS depletion transistor 132 and an NMOS transistor 133, thus forming an ED type reference voltage circuit.

Further, an overcurrent protection circuit 107*a* of FIG. 2 includes a sense transistor 121, which is current-mirror-connected to the output transistor 105, an NMOS depletion transistor 122, an NMOS transistor 123, a resistor 153, and a PMOS transistor 124. The difference from the conventional voltage regulator is that the NMOS depletion transistor 122, which operates in the non-saturation region, is used instead of the resistor 154.

The NMOS depletion transistor 132 has a drain connected to the power supply terminal 101, and a gate and a source which are connected to the inverting input terminal of the differential amplifier circuit 104. The NMOS transistor 133 has a gate and a drain which are connected to the source of the NMOS depletion transistor 132, and a source connected to the ground terminal 100.

The sense transistor 121 has a gate connected to the gate of the output transistor 105, a drain connected to a drain of the NMOS depletion transistor 122, and a source connected to the power supply terminal 101. The NMOS depletion transistor 122 has a gate and the drain which are connected to a gate of the NMOS transistor 123, and a source connected to the ground terminal 100. The NMOS transistor 123 has a source connected to the ground terminal and a drain connected to one terminal of the resistor 153. The other terminal of the resistor 153 is connected to the power supply terminal 101. The PMOS transistor 124 has a gate connected to the one terminal of the resistor 153, a source connected to the power supply terminal, and a drain connected to the gate of the output transistor 105.

In the voltage regulator having the above-mentioned configuration, overcurrent protection characteristics are determined by the characteristics of the NMOS depletion transistor 122 and the NMOS transistor 123, and the reference voltage Vref is determined by the characteristics of the NMOS depletion transistor 132 and the NMOS transistor 133. Therefore, when elements having the same characteristics are used as those transistors, there is a strong correlation between the reference voltage Vref and the maximum output current Im, and hence the maximum output current Im can be estimated from the output voltage Vout. In this case, the NMOS depletion transistor 122 and the NMOS depletion transistor 132 have the same threshold, and the NMOS transistor 123 and the NMOS transistor 133 have the same threshold.

According to the voltage regulator of this embodiment, with the use of the above-mentioned configuration, a test circuit is unnecessary and hence the chip area can be reduced, and further a measurement step by the test circuit can be eliminated. Thus, an effect of reducing manufacturing cost can be obtained.

Figure 3:
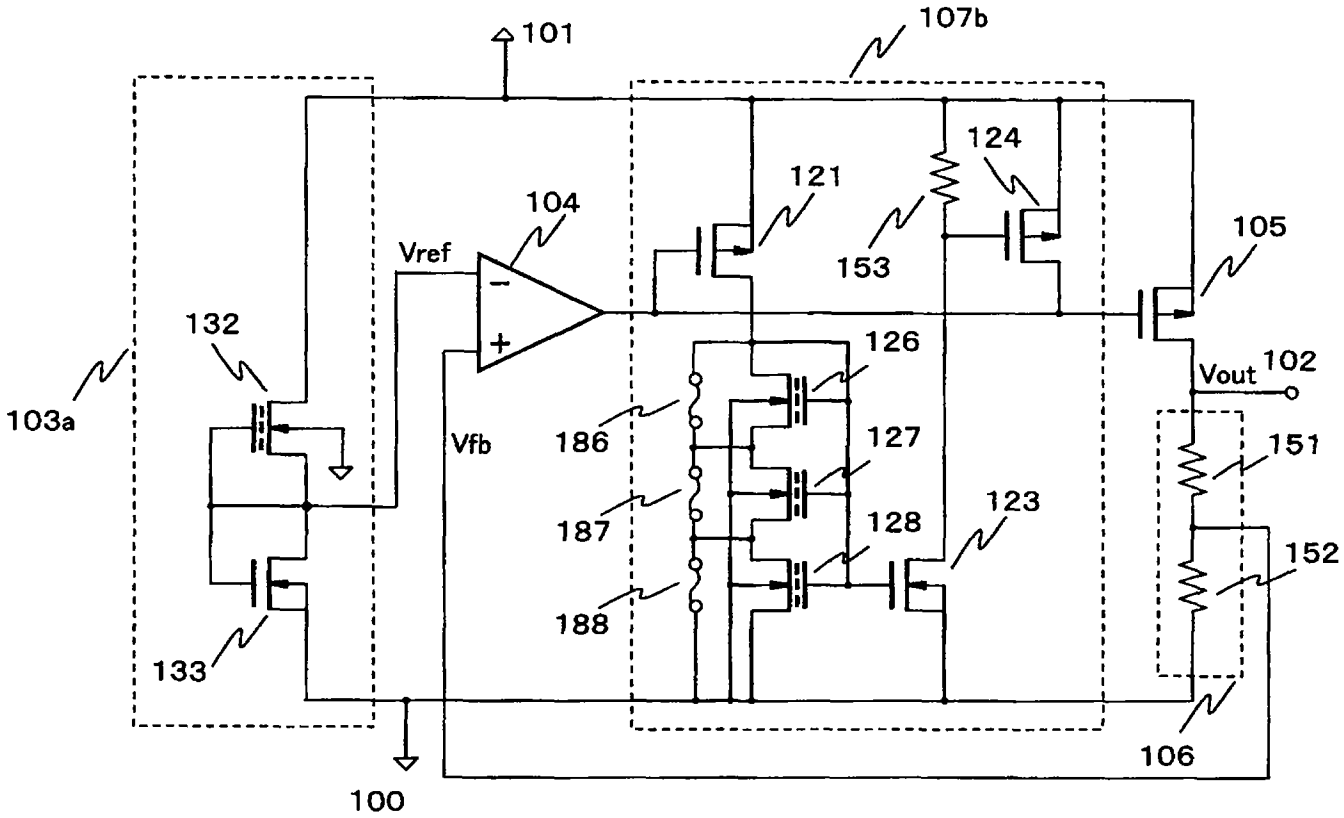
FIG. 3 is a circuit diagram illustrating another example of the voltage regulator of the embodiment of the present invention.

Note that, as illustrated by an overcurrent protection circuit 107*b* of FIG. 3, the NMOS depletion transistor 122 of the overcurrent protection circuit 107*a* may be replaced with series-connected N-channel depletion transistors 126, 127, and 128 so that trimming is performed by fuses 186, 187, and 188. When the overcurrent protection circuit 107 is configured as described above to perform trimming on the NMOS depletion transistors, the characteristics of the overcurrent protection circuit can be corrected optimally.

In this case, all the N-channel depletion transistors 132, 126, 127, and 128 have the same threshold.

However, the configuration of the N-channel depletion transistor and the fuse is not limited to the circuit described above, and the numbers of the N-channel depletion transistors and the fuses are not limited to the above.

Figure 4:
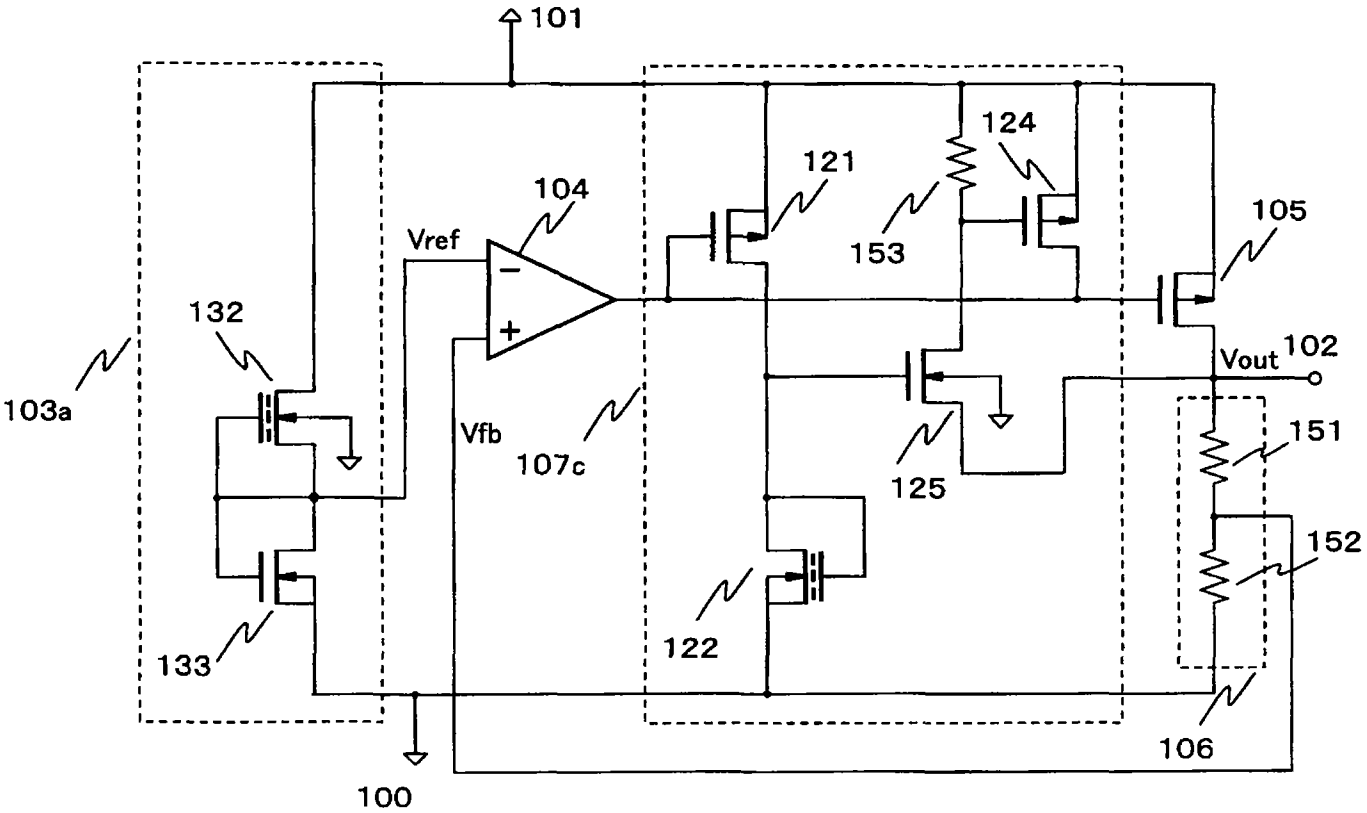
FIG. 4 is a circuit diagram illustrating another example of the voltage regulator of the embodiment of the present invention.

FIG. 4 is a circuit diagram illustrating another example of the voltage regulator of this embodiment. FIG. 4 illustrates another specific example of the overcurrent protection circuit 107.

An overcurrent protection circuit 107*c* of FIG. 4 is different from the overcurrent protection circuit 107*a* of FIG. 2 in that an NMOS transistor 125 is used instead of the NMOS transistor 123. The NMOS transistor 125 is different from the NMOS transistor 123 only in that a source thereof is connected to the output terminal 102. The overcurrent protection circuit 107*a* of FIG. 2 has drooping characteristics, and the overcurrent protection circuit 107*c* of FIG. 4 has fold-back characteristics.

Also in the overcurrent protection circuit 107*c* of FIG. 4, an output current exhibited when the output voltage Vout is 0 V, that is, the short-circuit current Is, is determined based on the characteristics of the NMOS transistor 125 and the NMOS depletion transistor 122. Therefore, the short-circuit current Is has a correlation with the reference voltage Vref, and hence the same effect can be obtained.

FIGS. 5 to 8 are circuit diagrams illustrating other examples of the voltage regulator of this embodiment. FIGS. 5 to 8 illustrate other specific examples of the reference voltage circuit 103.

Figure 5:
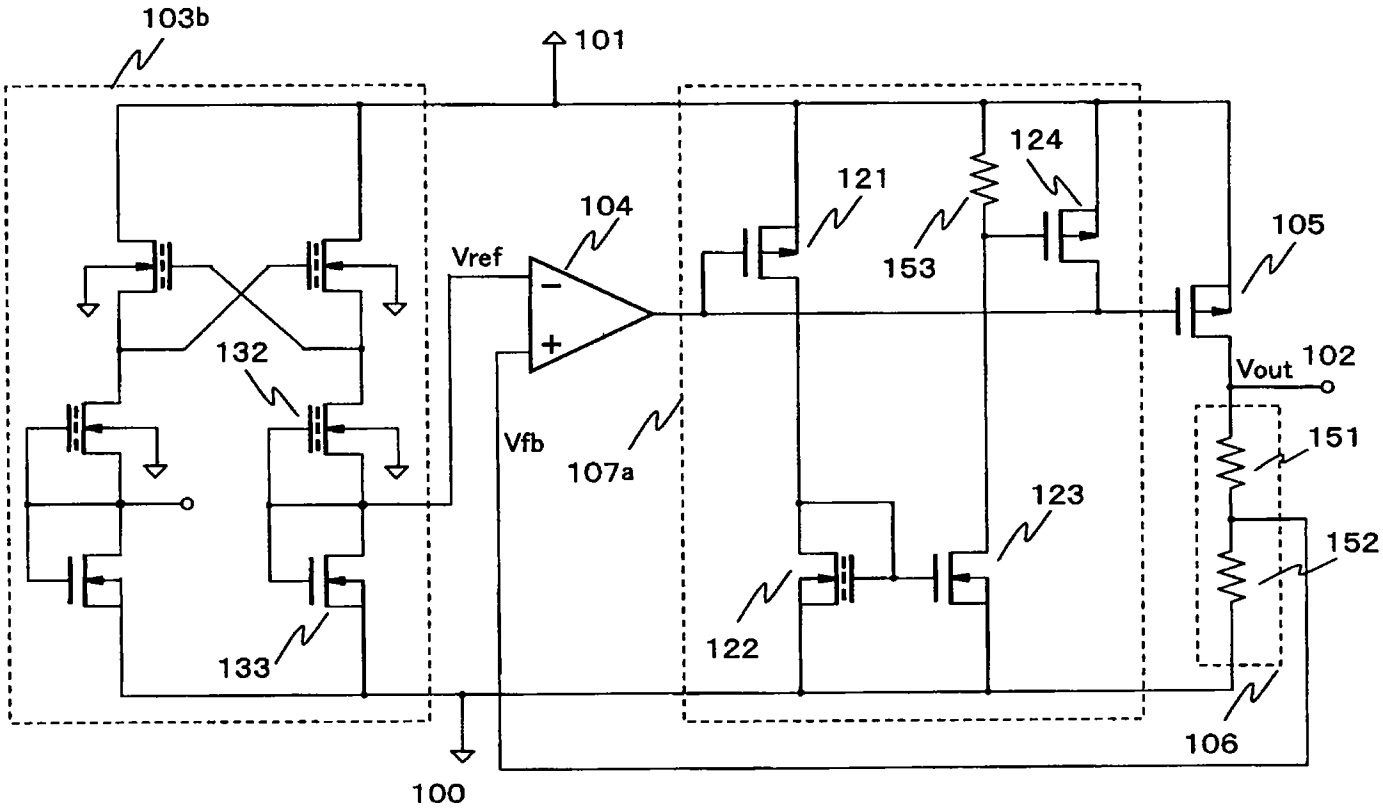
FIG. 5 is a circuit diagram illustrating another example of the voltage regulator of the embodiment of the present invention.

In a reference voltage circuit 103*b* of FIG. 5, the NMOS depletion transistor 122 and the NMOS depletion transistor 132 have the same threshold, and the NMOS transistor 123 and the NMOS transistor 133 have the same threshold.

Figure 6:
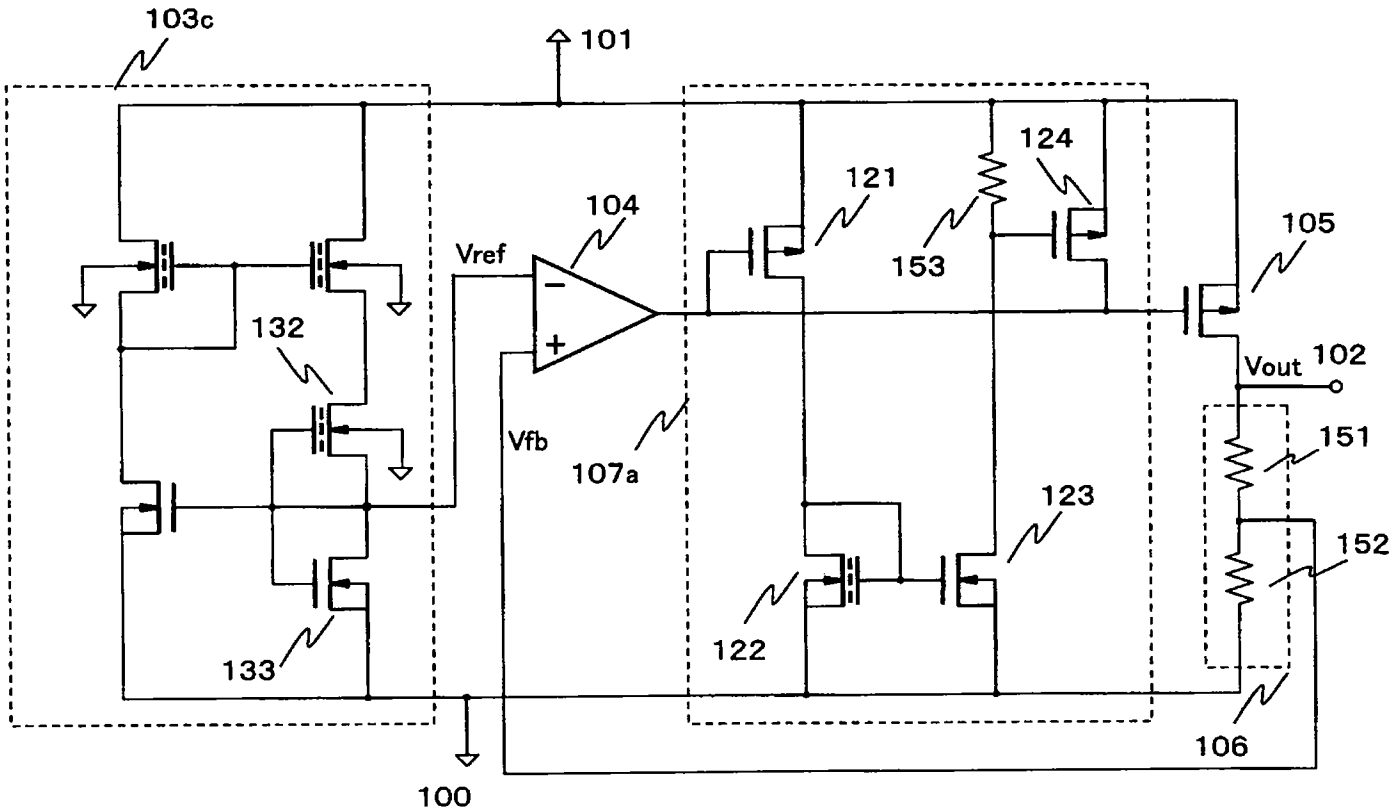
FIG. 6 is a circuit diagram illustrating another example of the voltage regulator of the embodiment of the present invention.

In a reference voltage circuit 103*c* of FIG. 6, the NMOS depletion transistor 122 and the NMOS depletion transistor 132 have the same threshold, and the NMOS transistor 123 and the NMOS transistor 133 have the same threshold.

Figure 7:
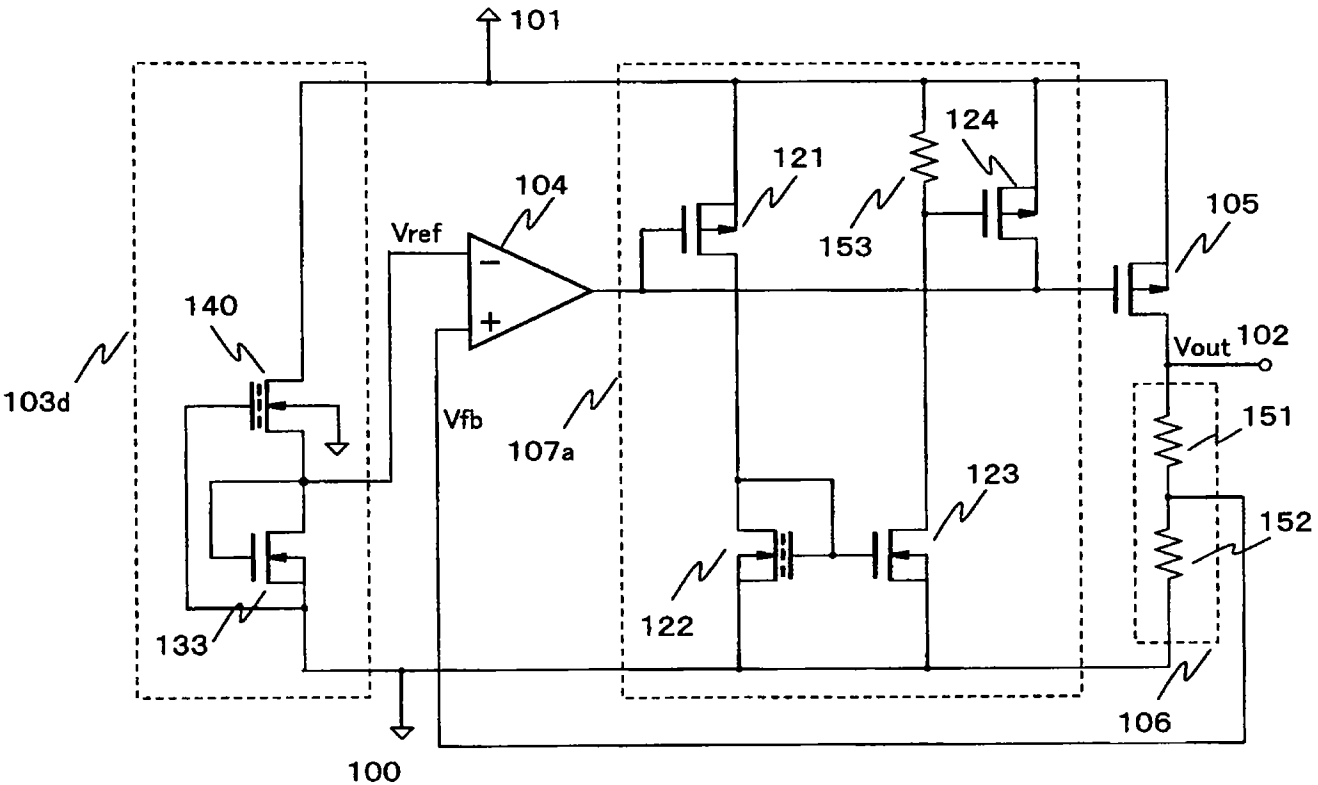
FIG. 7 is a circuit diagram illustrating another example of the voltage regulator of the embodiment of the present invention.

In a reference voltage circuit 103*d* of FIG. 7, the NMOS depletion transistor 122 and an NMOS depletion transistor 140 have the same threshold, and the NMOS transistor 123 and the NMOS transistor 133 have the same threshold.

Figure 8:
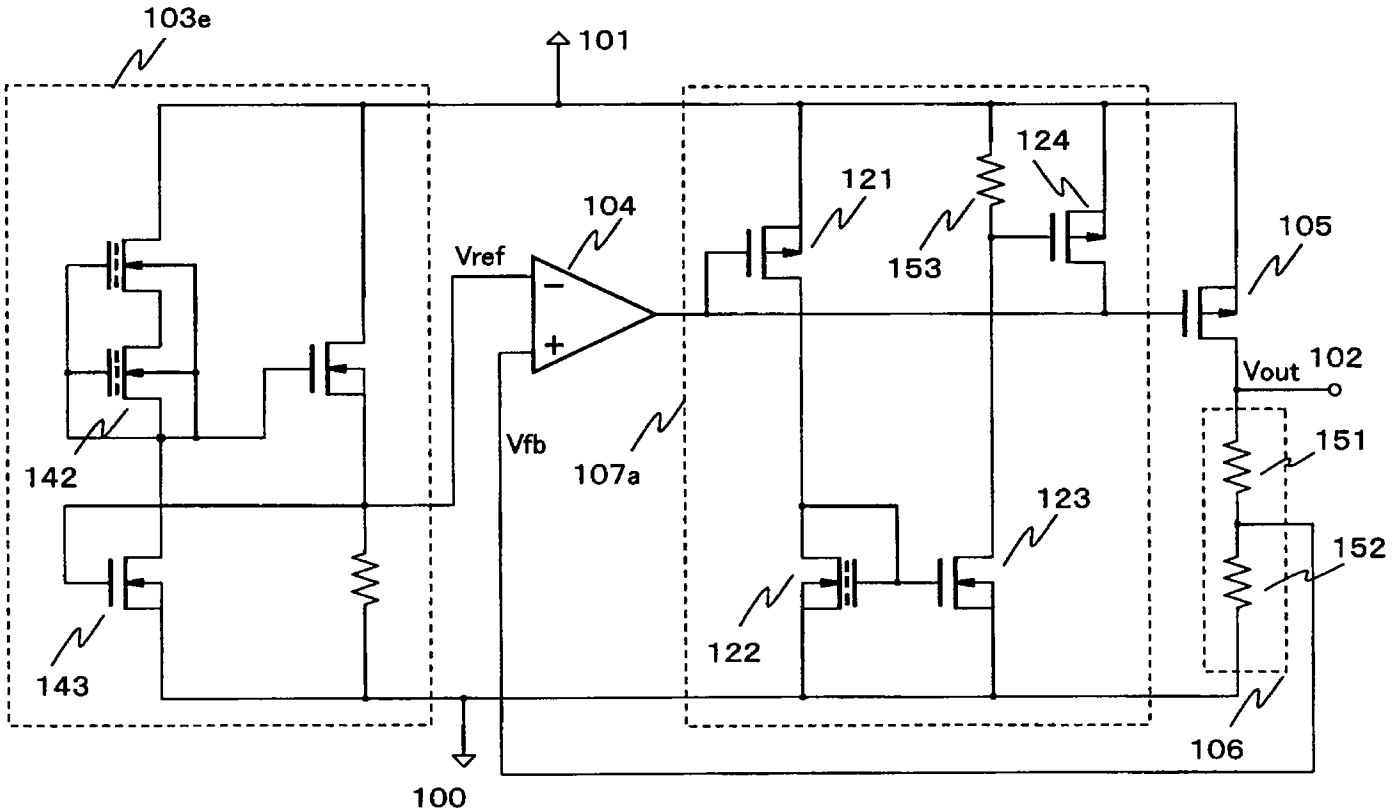
FIG. 8 is a circuit diagram illustrating another example of the voltage regulator of the embodiment of the present invention.
Figure 9:
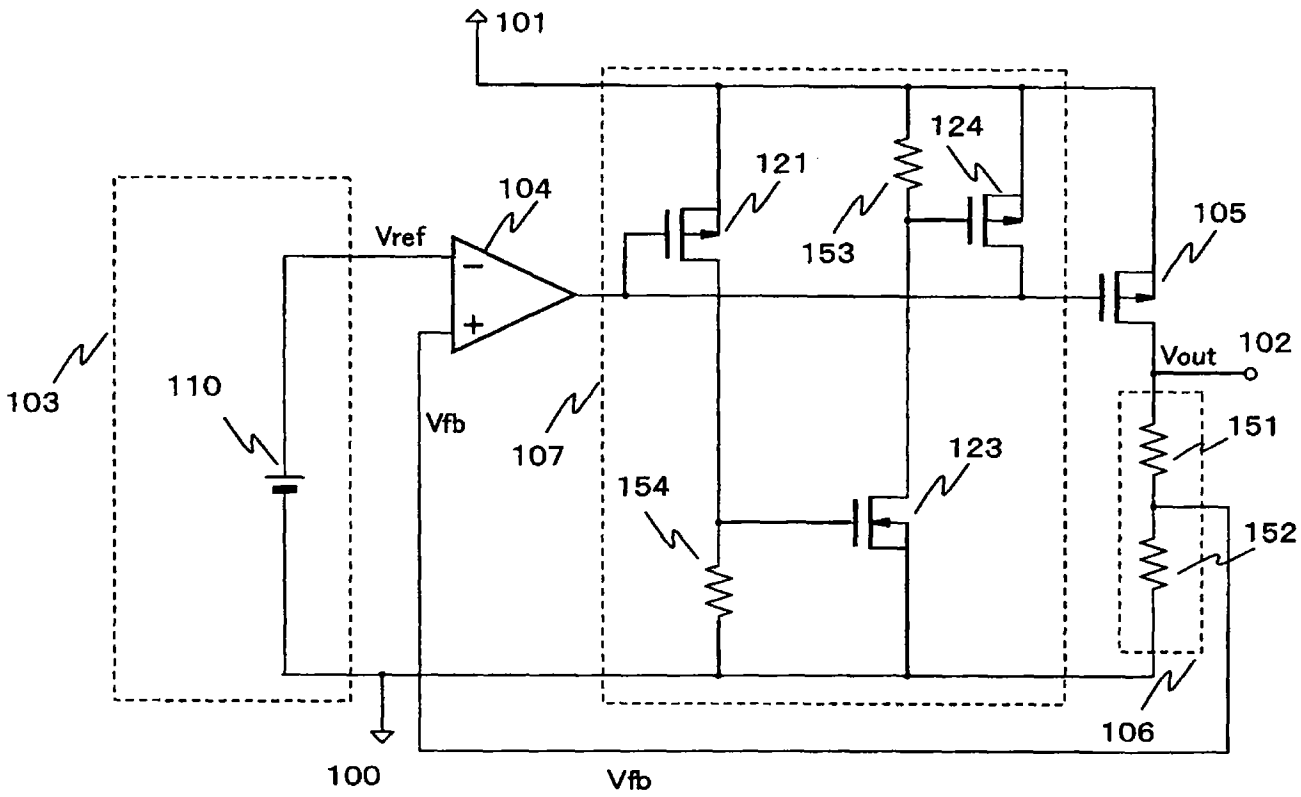
FIG. 9 PRIOR ART
FIG. 9 is a circuit diagram illustrating a conventional voltage regulator.
Figure 10:
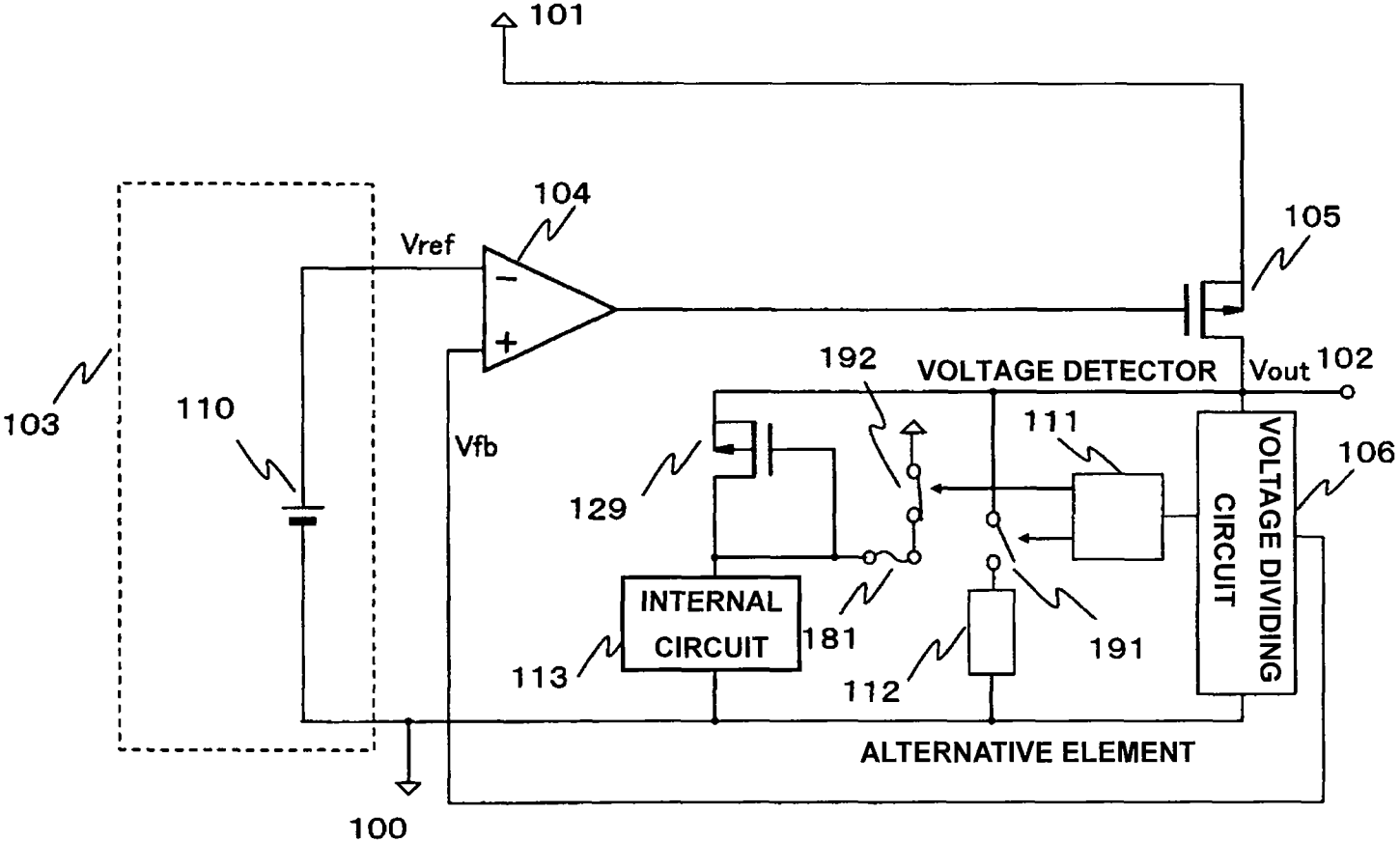
FIG. 10 PRIOR ART
FIG. 10 is a circuit diagram illustrating a conventional voltage regulator including a test circuit.

In a reference voltage circuit 103*e* of FIG. 8, the NMOS depletion transistor 122 and an NMOS depletion transistor 142 have the same threshold, and the NMOS transistor 123 and an NMOS transistor 143 have the same threshold.

As long as the reference voltage Vref is determined based on the characteristics of the NMOS depletion transistor and the NMOS transistor as described above, the effect of the present invention can be similarly obtained.

What is claimed is:

1. A voltage regulator, comprising:

a reference voltage circuit for outputting a reference voltage;

a differential amplifier circuit for comparing the reference voltage and a voltage which is based on an output voltage, and controlling a gate voltage of an output transistor so that the output voltage becomes constant; and an overcurrent protection circuit for detecting a flow of an overcurrent to the output transistor, and limiting a current of the output transistor, wherein the reference voltage circuit includes a first depletion transistor that determines the reference voltage and the overcurrent protection circuit includes a second depletion transistor that determines one of a maximum output current and a short-circuit current of the output transistor, the first depletion transistor of the reference voltage circuit and the second depletion transistor of the overcurrent protection circuit having the same characteristics, wherein the same characteristics comprise an identical threshold voltage of a depletion transistor.

2. A voltage regulator, comprising:

a reference voltage circuit for outputting a reference voltage;

a differential amplifier circuit for comparing the reference voltage and a voltage which is based on an output voltage, and controlling a gate voltage of an output transistor so that the output voltage becomes constant; and an overcurrent protection circuit for detecting a flow of an overcurrent to the output transistor, and limiting a current of the output transistor, wherein the reference voltage circuit includes an element that determines the reference voltage and the overcurrent protection circuit includes an element that determines one of a maximum output current and a short-circuit current of the output transistor, the element of the reference voltage circuit and the element of the overcurrent protection circuit having the same characteristics;

wherein:

the reference voltage circuit comprises a first NMOS depletion transistor and a first NMOS transistor;

the overcurrent protection circuit comprises:

a sense transistor for sensing an output current of the output transistor;

a second NMOS depletion transistor including a gate and a drain which are short-circuited, for allowing a current to flow through the sense transistor; and a second NMOS transistor which is current-mirror-connected to the second NMOS depletion transistor;

the element that determines the reference voltage comprises the first NMOS depletion transistor and the first NMOS transistor; and the element that determines the one of the maximum output current and the short-circuit current of the overcurrent protection circuit comprises the second NMOS depletion transistor and the second NMOS transistor.

* * * * *